US005799805A

United States Patent [19]

Mård et al.

[11] Patent Number: 5,799,805

[45] Date of Patent: Sep. 1, 1998

[54] METHOD FOR DAMPING THE LOAD SWING OF A CRANE

[75] Inventors: Olli Mård; Risto Ahvo, both of Helsinki, Finland

[73] Assignee: ABB Industry Oy, Helsinki, Finland

[21] Appl. No.: 565,950

[22] Filed: Dec. 1, 1995

[30] Foreign Application Priority Data

Dec. 13, 1994 [FI] Finland ..... 945859

[51] Int. Cl.[6] ..... B66C 13/06

[52] U.S. Cl. ..... 212/270; 212/275

[58] Field of Search ..... 212/275, 273, 212/270; 340/685

[56] References Cited

U.S. PATENT DOCUMENTS

| | | | |
|---|---|---|---|
| 4,717,029 | 1/1988 | Yasunobu et al. | 212/275 |
| 5,219,420 | 6/1993 | Kiiski et al. . | |
| 5,495,955 | 3/1996 | Shibata | 212/275 |

FOREIGN PATENT DOCUMENTS

| | | | |
|---|---|---|---|
| 0402790A3 | 12/1990 | European Pat. Off. . | |
| 0562124A1 | 4/1993 | European Pat. Off. . | |
| WO92/18416 | 10/1992 | WIPO . | |
| 94/11293 | 5/1994 | WIPO | 212/275 |
| WO94/11293 | 5/1994 | WIPO . | |

*Primary Examiner*—Thomas J. Brahan

*Attorney, Agent, or Firm*—Watson Cole Grindle Watson P.L.L.C.

[57] ABSTRACT

The invention relates to a method for damping the load swing of a crane during the traversing motion of a load-carrying trolley and/or a trolley-carrying bridge. The method comprises determining substantially continuously the acceleration of the trolley/bridge and the instantaneous swing time constant, swing velocity (v) and deviation (s) from equilibrium of the pendulum formed by the load. When the velocity reference changes, the acceleration providing the desired change in velocity is determined, said acceleration being switched on immediately, and the acceleration compensating for the swing prevailing at the moment of change of the velocity reference is determined, said acceleration being switched on either immediately or, if the compensating acceleration exceeds the maximum acceleration permissible to the traversing drive when switched on immediately, when the pendulum formed by the load has reached its extreme position.

7 Claims, 3 Drawing Sheets

METHOD FOR DAMPING THE LOAD SWING OF A CRANE

Figure 1:
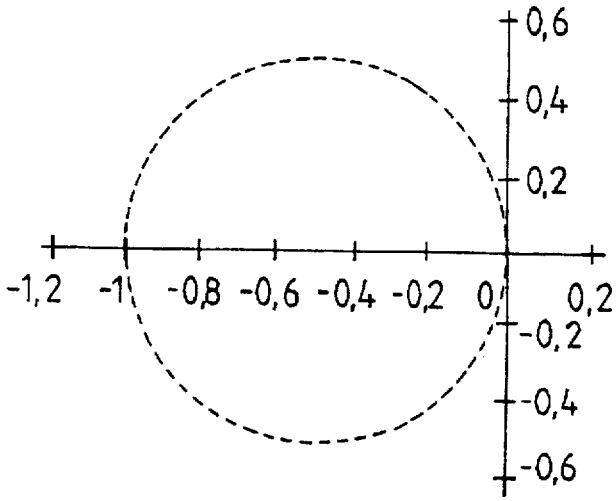

The invention relates to a method for damping the load swing of a crane during the traversing motion of a load-carrying trolley and/or a trolley-carrying bridge when the trolley/bridge is controlled by giving the traversing drive of the trolley/bridge a velocity reference corresponding to the desired traversing direction and velocity, said method comprising determining substantially continuously the acceleration of the trolley/bridge and the instantaneous swing time constant, swing velocity and deviation from equilibrium of the pendulum formed by the load, and when the velocity reference changes, determining a control compensating for the instantaneous swing, and a control providing a desired change in velocity, said control being switched on for a time determined by the instantaneous swing time constant of the pendulum. The invention thus relates to a method for controlling the traversing drive of a crane in such a manner that undesired after-oscillation of the load is eliminated after the desired changes in velocity.

The swing of a load suspended on a hoisting rope causes problems when a crane is used to handle material. Depending on the mass of the load, quite a significant amount of kinetic energy is bound in the swinging load, which may cause dangerous situations or damages either to the load itself or to the environment. It also takes an inexperienced operator some time to control the swing when the load is deposited, since the correction movements must be correctly timed and of an appropriate magnitude. It is thus a demanding task to stop the traversing motion at a correct point in such a way that no swing of the load occurs. The deposition of the load therefore often takes as long a time as the actual traversing motion. Undesirable swing thus reduces the efficiency of a crane.

Load swing has been studied to a great extent, and automatic solutions have been developed. The conventional solutions can be divided into two main categories: 1) control based on feedback data, and 2) open control based on advance calculations of suitable acceleration and deceleration ramps.

Systems based on feedback control require information on the position of the load with respect to the lifting trolley; the control algorithm arrests the load swing on the basis of this information. These systems operate excellently at least in laboratories, but the problem with them is that they are complicated and expensive, and the sensor arrangement is difficult to implement and unreliable in practice. The advantage of feedback systems is their ability to compensate for the effect of external disturbances, such as wind.

The advantage of open systems is that they are uncomplicated and inexpensive, wherefore they are useful in practical implementations. The system needs information merely on the length of the hoisting rope, which can be measured in many different ways. In connection with vector adjustment of a cage induction motor, for example, the length of the hoisting rope can be measured for free by means of a pulse tachometer included in the system.

U.S. Pat. No. 5,219,420 discloses a crane control method similar to the one described in the introductory paragraph. The swing-compensating control disclosed in the U.S. patent comprises a first and a second acceleration reference. Alternatively, the unrealized parts are appropriately removed from the acceleration sequences. The change in velocity, in turn, is provided by forming new acceleration sequences, which change the velocity so that it corresponds to the new set value without the occurrence of any swing.

The acceleration which changes the velocity can be switched on immediately, but the acceleration which compensates for the swing cannot be switched on until the pendulum has swung to its extreme position, which retards the control of the crane. Moreover, the calculations needed in the method are relatively complicated.

European Patent Application No. 583,268 discloses a method of controlling a crane wherein the swing is actually not compensated for; instead, when the velocity reference changes, the control sequence providing the desired change in velocity is added to the existing control sequences. Since individual control sequences do not cause swing as such, there exists no need for swing compensation, i.e. it is not necessary to calculate the acceleration compensating for the swing. The application thus discloses a control method which as such does not cause swing. Consequently, swing—e.g. caused by the length of the hoisting rope, which changes during acceleration—cannot be compensated for.

The object of the present invention is to provide such a control method based on open control where the above limitations do not have to be taken into account. This is achieved with a method of the invention, which is characterized in that the control providing the desired change in velocity is an acceleration switched on immediately when the velocity reference changes, and the control compensating for the swing prevailing at the moment of change of the velocity reference is an acceleration which is also switched on immediately unless the maximum acceleration permissible to the traversing drive is exceeded. If the acceleration compensating for the swing, immediately after being switched on, is higher than the maximum acceleration permissible to the traversing drive, the acceleration compensating for the swing is switched on when the pendulum formed by the load has reached its extreme position. The method allows the velocity reference to change at any time, even during acceleration or deceleration. When the desired final velocity is achieved, the swing of the load is eliminated.

The compensating acceleration used in the method of the invention is preferably proportional to the diameter of the circle which, in a system of rectangular coordinates defined by the swing velocity and the deviation from equilibrium, runs through the origin and the point determined by the velocity of the swing and the deviation from equilibrium prevailing at the moment of change of the velocity reference.

If the compensating acceleration is switched on immediately, its duration $t_{a1}$ is determined from the formula $$t_{a1}=(\Theta/2\pi)\tau,$$

where $\tau$ is the instantaneous swing time constant, and $\Theta$ that central angle which is defined by the point determined by the swing velocity and the deviation from the equilibrium when it moves along the circumference of the circle in a clockwise direction to the origin.

If the compensating acceleration is switched on when the pendulum formed by the load has reached its extreme position, its duration $t_{a1}$ is determined from the formula $$t_{a1}=\tau/2,$$

where $\tau$ is the instantaneous swing time constant of the pendulum.

Figure 1A:
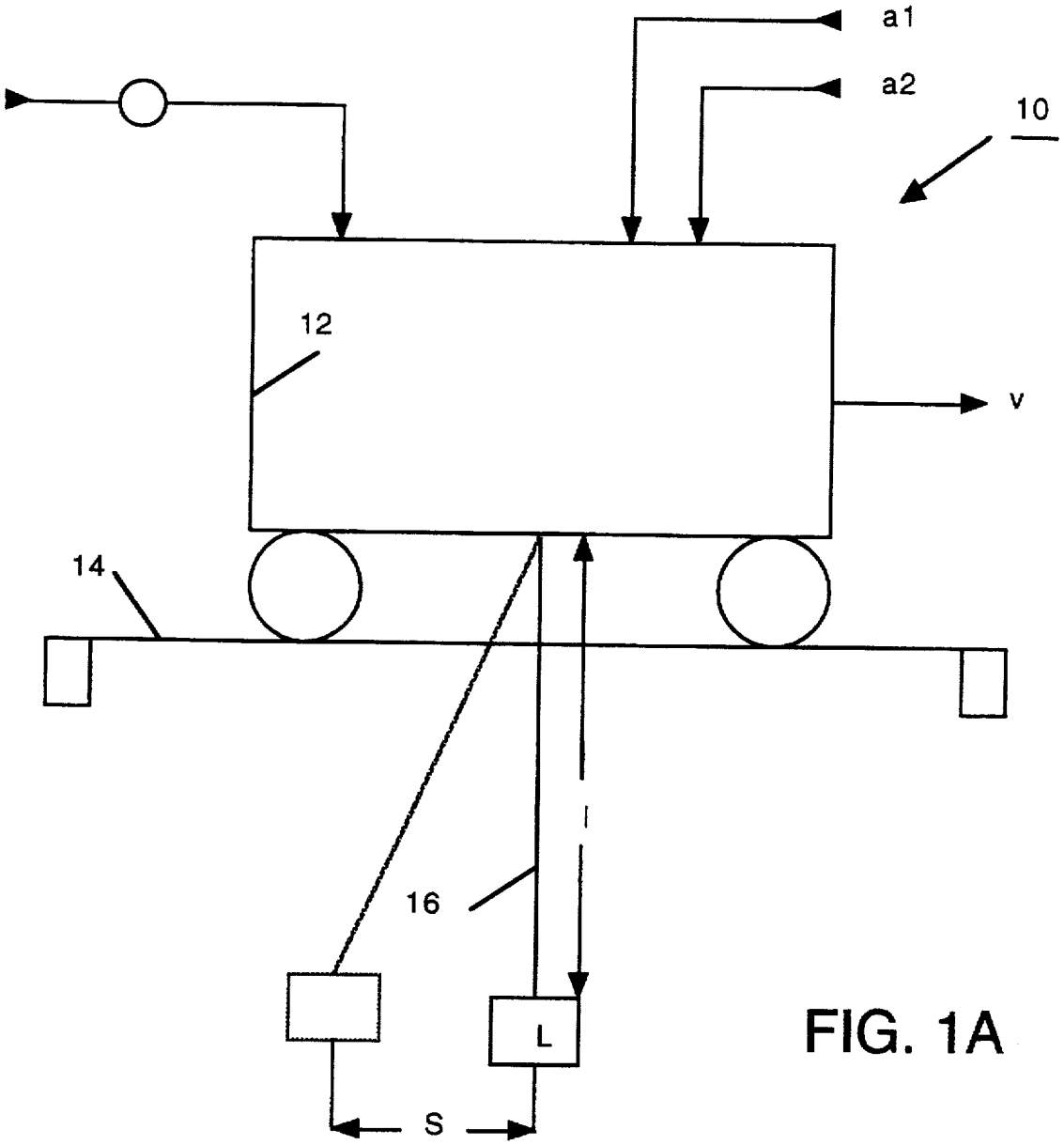

In the following, the invention will be described in greater detail with reference to the accompanying drawings, in which FIG. 1 shows a figure drawn by the pendulum during an acceleration sequence of one swing time constant in a scaled system of coordinates, FIG. 1A is a schematic illustration of a crane employing the control system according to the present invention.

Figure 2:
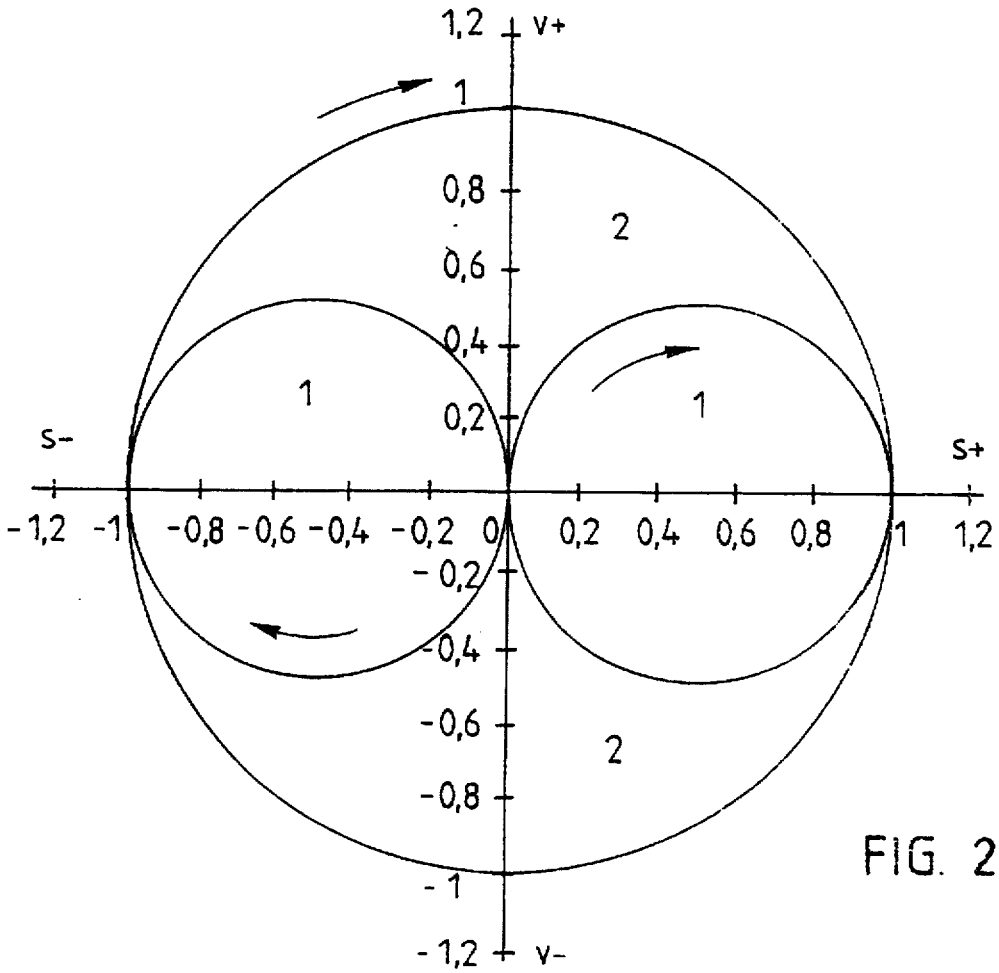
Figure 3:
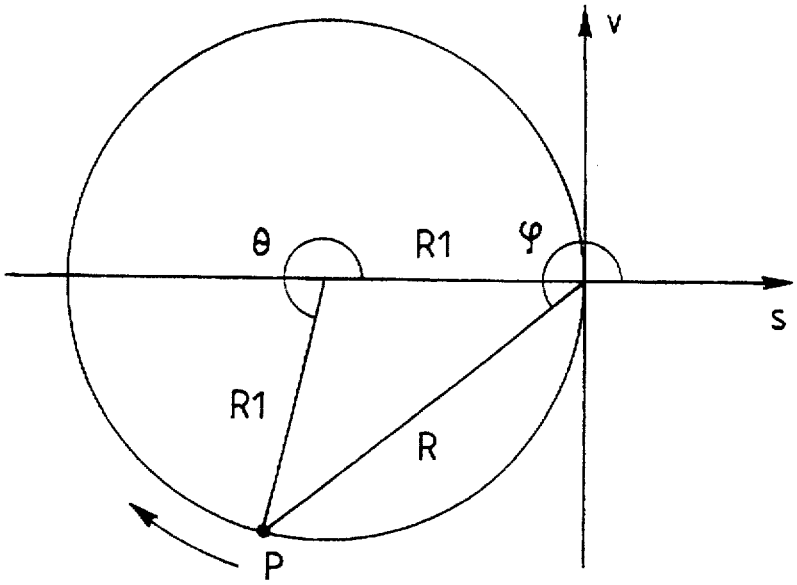

FIG. 2 shows circles drawn by the pendulum during the highest permissible acceleration of one swing cycle in both directions, and the maximum swing obtainable by discontinuing the acceleration in a scaled system of coordinates, and FIG. 3 shows a circle running through the origin and the point corresponding to the state of the pendulum at the moment of change of the velocity reference in a scaled set of coordinates.

The control method of the invention comprises continuously determining the swing time constant $\tau$, the swing velocity V and the swing angle $\alpha$ of the pendulum. The pendulum formed by a suspended load is assumed to behave as a mathematical pendulum; the swing time constant $\tau$ can be calculated if the length of the swing arm 1 is known:

$$\tau = 2\pi\sqrt{\frac{l}{g}} \approx 2{,}006\sqrt{l} \tag{1}$$

When the swing velocity V and the swing angle $\alpha$ are calculated, the maximum swing is assumed to be so small that, in practice, linearization $$\alpha = \arctan a/g \approx a/g \tag{2}$$

does not cause an error. The swing velocity $V_i$ of the pendulum and the deviation $S_i$ from equilibrium at a time instant i are determined by means of acceleration a of the crane trolley or bridge, obtained from the traversing drive, and the measured length l of the hoisting rope by a $\Delta$-method as follows:

$$V_i = V_{i-1} + \left(a - \frac{S_{i-1}}{l}\, g\right)\Delta t \tag{3}$$

$$S_i = S_{i-1} + V_i \Delta t$$

To allow the phase of the swing and the corresponding acceleration to be determined, the calculated absolute values must be appropriately scaled. The scaling is performed by the use of swing velocity and swing angle values obtained from an initial state where no swing occurs with the highest permissible acceleration $a_{max}$:

$$S_{max} = 2l\frac{a_{max}}{g} \tag{4}$$

$$V_{max} = \frac{2a_{max}l}{\sqrt{lg}} = \frac{2a_{max}\sqrt{l}}{\sqrt{g}}$$

Thus, the relative values for deviation si from equilibrium and swing velocity $V_i$ are obtained as follows:

$$s_i = \frac{S_i}{S_{max}} \tag{5}$$

$$v_i = \frac{V_i}{V_{max}}$$

In the resulting scaled system of sv coordinates, the figure drawn by an acceleration sequence of one swing time constant $\tau$ will thus be a circle according to FIG. 1.

FIG. 1A illustrates a crane system 10 utilizing a control system according to the invention wherein a movable trolley 12 is carried on a fixed or movable support 14. The trolley 12 carries a load L suspended by a cable 16 of length l which together form a pendulum having a maximum swing or deviation s like the trolley 12 moves at velocity v. The load L makes an angle $\Theta$ at the maximum deviation s.

Stopping the acceleration started from an initial state where no swing occurs after half a swing cycle will result in the maximum swing obtainable during one acceleration sequence. FIG. 2 shows this maximum swing obtainable by stopping the acceleration, and the circles drawn by the pendulum during the highest possible acceleration of one swing sequence in both directions. FIG. 2 also shows the directions of rotation of the circles drawn by the pendulum during acceleration sequences in both directions. It should be noted that the term 'acceleration' is also used to refer to deceleration, i.e. acceleration against the direction of velocity.

From FIG. 2 it can be deduced that, starting from an arbitrary initial state, the compensation for swing can be divided into two different cases:

1) The point illustrating the state of the pendulum is located within the area defined by the maximum acceleration or deceleration sequence. These circular areas are indicated in FIG. 2 by reference numeral 1.
2) The point illustrating the state of the pendulum is located outside the area defined by the maximum acceleration or deceleration sequence but within the circle illustrating the maximum swing. These areas are indicated in FIG. 2 by reference numeral 2.

When a crane is controlled by the method of the present invention, the swing, in principle, never extends outside area 2 in FIG. 2. In other words, the swing of the load during changes in velocity is limited to the value corresponding to the maximum acceleration of the drive.

The compensation for swing in area 1 will be examined at first. In this area, it is possible to proceed from any point to the origin by switching on acceleration corresponding to a circle which runs through the origin and the point corresponding to the instantaneous state of the pendulum. The duration of the acceleration corresponds to the length of the arc between these points. Such a circle is shown in FIG. 3. The circle and the length of the arc comprising the remaining part of the circumference are calculated according to the following procedure:

The variables shown in FIG. 3 are calculated at first: R is the distance of point P (=$S_i$; $V_i$), representing the state of the pendulum, from the origin; $R_1$ is the radius; $\phi$ is the angle between vector R and the positive s-axis in the clockwise direction; and $\Theta$ is the central angle defined by point P, representing the state of the pendulum, when it moves along the circumference of said circle in a clockwise direction to the origin.

$$R = \sqrt{s_i^2 + v_i^2} \tag{6}$$

$$v_i \geqq 0 \rightarrow \phi = \arccos\left(\frac{s_i}{R}\right) \tag{7}$$

$$v_i < 0 \rightarrow \phi = 2\pi - \arccos\left(\frac{s_i}{R}\right)$$

$$0 \leqq \phi < \frac{\pi}{2} \rightarrow \theta = 2\phi + \pi \tag{8}$$

$$\frac{\pi}{2} \leqq \phi < \frac{3\pi}{2} \rightarrow \theta = 2\phi - \pi$$

$$\frac{3\pi}{2} \leqq \phi \leqq 2\pi \rightarrow \theta = 2\phi - 3\pi$$

-continued $$R_1 = \left| \frac{R\sin\phi}{\sin\theta} \right| \tag{9}$$

The parameter AREA, pertaining to areas 1 and 2 defined in connection with FIG. 2, determines which compensation strategy is selected. It is determined on the basis of the length of the radius $R_1$ as follows:

$$R_1 \leqq 0{,}5 \rightarrow \text{AREA}=1$$

$$R_1 > 0{,}5 \rightarrow \text{AREA}=2 \tag{10}$$

Thus, if $R_1 \leqq 0{,}5$, the pendulum is located within area 1 of FIG. 2, and the compensating acceleration can be switched on immediately. Variable $R_1$ or the diameter $2R_2$ of the circle corresponds to this acceleration, and angle $\Theta$ corresponds to the time $t_{a1}$ it takes the pendulum to proceed to the origin. The time in seconds can be obtained by means of the swing time constant:

$$t_{a1} = \frac{\theta}{2\pi}\tau \tag{11}$$

In addition, the direction coefficient k must be calculated for the acceleration $a_1$:

$$S_f < 0 \rightarrow k=1$$

$$S_f < 0 \rightarrow k=-1$$

$$S_f = 0 \rightarrow k=0 \tag{12}$$

Thus, the absolute acceleration compensating for the swing is calculated as follows:

$$a_1 = 2kR_1 a_{max} \tag{13}$$

It is unlikely that this acceleration pulse will provide the desired change in velocity for the traversing motion. It is therefore necessary to add to it acceleration which as such does not cause swing but provides the desired change in velocity. This will be dealt with more closely later on. Compensation in area 2 of FIG. 2 will be examined in the following.

The acceleration leading to the origin in area 2 cannot be switched on immediately, as its absolute value would be higher than the maximum acceleration permissible to the traversing drive, i.e. $2R_1$ would be higher than 1. The compensating acceleration could, in principle, be switched on as soon as area 1 is reached, but, in practice, it is easier to calculate the time it takes the pendulum to reach its extreme position—or to proceed to the s-axis in the system of coordinates of FIG. 2—and to switch on the compensating acceleration only at this point. In this case, the pendulum is most probably (theoretically always) located in area 1 or at least at its boundary.

The swing time to the extreme position is obtained by means of the previously calculated angle $\phi$:

$$0 \leqq \phi < \pi \rightarrow t = \frac{\phi}{2\pi}\tau \tag{14}$$

$$\pi \leqq \phi < 2\pi \rightarrow t = \frac{\phi - \pi}{2\pi}\tau$$

The duration $t_{a1}$ of the compensating acceleration is naturally half of the swing time constant $\tau$ of the pendulum (the distance to the origin corresponds to half of the circumference of the circle):

$$t_{a1} 2/\tau \tag{15}$$

The direction coefficient k is determined as follows:

$$V_f > 0 \rightarrow k=1$$

$$V_f < 0 \rightarrow k=-1 \tag{16}$$

If $V_1$ is zero, the direction coefficient is calculated from formulae (12). The absolute value of the acceleration $a_1$ to be switched on corresponds to the previously calculated distance R from the origin; thus, its absolute value is:

$$a_1 = kRa_{max} \tag{17}$$

The swing-compensating acceleration a, thus calculated provides the change $\Delta V_1$ in velocity $$\Delta V_1 = a_1 t_{a1} \tag{18}$$

As in the case of area 1, it is still necessary to add to acceleration $a_1$ a suitable acceleration $a_2$ which as such does not cause swing but aims at providing the desired change in velocity. The duration of acceleration $a_2$ is the instantaneous swing time constant $\tau$ of the pendulum, and it is switched on immediately when the velocity reference $V_{ref}$ changes. The required acceleration $a_2$ is calculated according to the following procedure, where $\Delta V_2$ is the change of velocity resulting in the final velocity, and $V_{olol}$ is the instantaneous value of velocity:

$$\Delta V_2 = V_{ref} - V_{olo} \Delta V_1 \tag{19}$$

If $\Delta V_1$ and $\Delta V_2$ are with like signs, the absolute value of acceleration $a_2$ is selected to be:

$$|a_2| = \min\left[ |a_{max}| - |a_1|, \left| \frac{\Delta V_2}{\tau} \right| \right] \tag{20}$$

Thus the final acceleration $a_2$ can be expressed as:

$$a_2 = k|a_2| \tag{21}$$

If $\Delta V_1$ and $\Delta V_2$ are with different signs, the following formula is selected:

$$|a_2| = \min\left[ |a_{max}|, \left| \frac{\Delta V_2}{\tau} \right| \right] \tag{22}$$

The final acceleration $a_2$ can thus be written in the form:

$$a_2 = -k|a_2| \tag{23}$$

If it has been necessary to select the first one of the limitations of Formulae (20) and (22), accelerations $a_1$ and $a_2$ together cannot provide the 10 desired change in velocity. In this case, it is necessary to use, in addition to the two accelerations mentioned above, a third acceleration $a_3$, which is parallel to acceleration $a_2$. The magnitude of acceleration $a_3$ is calculated as follows:

$$a_3 = \frac{\Delta V_2 - a_2\tau}{\tau} \tag{24}$$

Acceleration $a_3$ is switched on immediately after acceleration $a_1$ has been performed, if the condition $$|a_2 + a_3| \leqq |a_{max}| \tag{25}$$

is true. In the opposite case, it is not switched on until after acceleration $a_2$ has been performed, i.e. one swing time constant after the velocity reference has changed.

Theoretically, the system described above operates with a constantly changing velocity reference. In practice, the velocity reference must be stepped, or the calculation must be performed only if there is a significant change in the velocity reference; otherwise new values may have to be calculated continually for acceleration sequences, whereby the cumulative timing and rounding errors gradually distort the result.

We claim:

1. A method for damping the load swing of a crane during the traversing motion of a pendulum load secured to a load-carrying means driven by a traversing drive and responsive to a changeable velocity reference corresponding to the desired traversing direction and velocity of the load-carrying means, said traversing drive having a predetermined maximum acceleration and said load having a predetermined maximum swing comprising the steps of:

determining substantially continuously an acceleration of the load-carrying means, an instantaneous switching time constant of the pendulum load, a swing velocity and a deviation from equilibrium of the pendulum load;

compensating for instantaneous load swings when the velocity of the reference changes, by determining a control compensating for the instantaneous swing, said control in the form of a first acceleration, immediately switching on said first acceleration unless the pendulum swing exceeds the maximum acceleration;

delaying switching on said first acceleration until the pendulum swing or less than the maximum acceleration;

compensating for velocity reference changes by determining a control for providing a desired change in velocity in the form of a second acceleration, immediately switching said second acceleration on whenever the velocity reference changes for a time corresponding to the instantaneous swing time constant of the pendulum; and applying the switched on first and second accelerations to the traversing drive.

2. A method according to claim 1 wherein, if the first acceleration when switched on immediately exceeds the maximum acceleration permissible to the traversing drive, the second acceleration is switched on when the pendulum load has reached maximum swing.

3. A method according to claim 2, wherein, the first acceleration has a duration $t_{ai}$ when switched on when the pendulum load reaches the maximum swing, said duration being determined from a formula $$t_{ai}=\tau/2$$

wherein, $\tau$ is the instantaneous swing time constant of the pendulum.

4. A method according to claim 2 wherein the first acceleration as proportional to a diameter of a circle in a system a rectangular coordinates having an origin defined on one axis by swing velocity and on an orthogonal axis by deviation of the load from equilibrium, said circle running through the origin and a point P determined by the instantaneous swing velocity and instantaneous deviation from equilibrium prevailing when the velocity reference changes.

5. A method according to claim 4, wherein, if the first acceleration has a duration $t_{ai}$ when switched on immediately, said duration being determined from a formula $$t_{a1}=(\theta/2\pi)\tau,$$

wherein $\tau$ is the instantaneous swing time constant, and $\theta$ is the central angle defined by the point determined by the swing velocity ($V_i$ and the deviation $S_i$)) from equilibrium when it moves along the circumference of the said circle in a clockwise direction to the origin.

6. A method according to claim 1 wherein, the first acceleration is proportional to the diameter a circle in a system of rectangular coordinates, having an origin defined on one axis by swing velocity and on orthogonal axis by deviation of the load from equilibrium, said circle running through the origin and a point P determined by the instantaneous swing velocity and instantaneous deviation from equilibrium prevailing when the velocity reference changes.

7. A method according to claim 6, wherein, the first acceleration has a duration $t_{ai}$ when switched on immediately, said duration being determined from a formula $$t_{a1}=(\theta/2\tau)\tau,$$

wherein $\tau$ is an instantaneous swing time constant, and $\theta$ is a central angle defined by the point P when it moves along the circumference of said circle in a clockwise direction with respect to the origin.

* * * * *

UNITED STATES PATENT AND TRADEMARK OFFICE

CERTIFICATE OF CORRECTION

PATENT NO. : 5,799,805

DATED : September 1, 1998

INVENTOR(S) : Olli MARD et al.

It is certified that error appears in the above-identified patent and that said Letters Patent is hereby corrected as shown below:

Column 7, line 27, (Claim 1, line 20), after "swing", insert --is equal to--.

Signed and Sealed this

Twenty-first Day of November, 2000

*Attest:*

Q. TODD DICKINSON

*Attesting Officer*

*Director of Patents and Trademarks*